US010385286B2

(12) United States Patent
Pintar et al.

(10) Patent No.: US 10,385,286 B2
(45) Date of Patent: Aug. 20, 2019

(54) METHODS AND SYSTEMS FOR MANUFACTURING LUBRICATION OILS

(71) Applicant: UOP LLC, Des Plaines, IL (US)

(72) Inventors: Daniel James Pintar, Hoffman Estates, IL (US); Pamela Roxas, Chicago, IL (US); Vasant P. Thakkar, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 307 days.

(21) Appl. No.: 14/104,770

(22) Filed: Dec. 12, 2013

(65) Prior Publication Data

US 2015/0166906 A1 Jun. 18, 2015

(51) Int. Cl.

| | |
|---|---|
| ***C10G 67/00*** | (2006.01) |
| ***C10M 101/02*** | (2006.01) |
| ***C10G 25/02*** | (2006.01) |
| ***C10G 67/06*** | (2006.01) |

(52) U.S. Cl.

CPC ..... *C10M 101/02* (2013.01); *C10G 25/02* (2013.01); *C10G 67/06* (2013.01); *C10G 2300/201* (2013.01); *C10M 2203/003* (2013.01); *C10M 2203/1085* (2013.01); *C10N 2270/00* (2013.01)

(58) Field of Classification Search

CPC ..... C10M 101/02; C10M 2203/003; C10M 2203/1085; C10G 65/12; C10G 67/06; C10G 25/02; C10G 2300/201; C10N 2270/00

See application file for complete search history.

(56) References Cited

U.S. PATENT DOCUMENTS

| | | | | |
|---|---|---|---|---|
| 2,767,131 | A | 10/1956 | Jezl et al. | |
| 4,977,871 | A | 12/1990 | Brownawell et al. | |
| 5,094,747 | A | 3/1992 | Johnson | |
| 5,225,081 | A | 7/1993 | Brownawell | |
| 5,464,526 | A | 11/1995 | Saunders | |
| 5,554,307 | A | 9/1996 | Dagorn et al. | |
| 6,569,313 | B1 * | 5/2003 | Carroll | C10G 65/12 208/108 |
| 2009/0156876 | A1 | 6/2009 | Ou et al. | |
| 2010/0252483 | A1 | 10/2010 | Koseoglu | |
| 2012/0000829 | A1 | 1/2012 | Dougherty et al. | |
| 2012/0157738 | A1 | 6/2012 | Jan et al. | |
| 2013/0008827 | A1 | 1/2013 | Nagayasu et al. | |
| 2013/0220885 | A1 | 8/2013 | Low et al. | |

OTHER PUBLICATIONS

Filho, et al., "Polycyclic Aromatic Hydrocarbons (PAHs) Adsorption on Solid Surfaces Applied to Waste Lubricant Oils Recovery Process," Canadian Journal of Chemical Engineering, v 88, n 3, p. 411-416, Jun. 2010.

Search Report dated Mar. 11, 2015 for corresponding PCT Appl. No. PCT/US2014/068006.

* cited by examiner

*Primary Examiner* — Prem C Singh
*Assistant Examiner* — Brandi M Doyle
(74) *Attorney, Agent, or Firm* — Paschall & Maas Law Office; Jame C. Paschall

(57) ABSTRACT

Disclosed are methods and systems for manufacturing lubrication oils. In one embodiment, a method for manufacturing a lubrication oil includes the steps of receiving into an activated carbon guard bed unit an unconverted oil (UCO) feedstock, the UCO feedstock comprising polynuclear aromatic (PNA) compounds and contacting the UCO feedstock with activated carbon within the activated carbon guard bed unit to remove at least a portion of the PNA compounds, thereby forming a treated UCO feedstock.

17 Claims, 1 Drawing Sheet

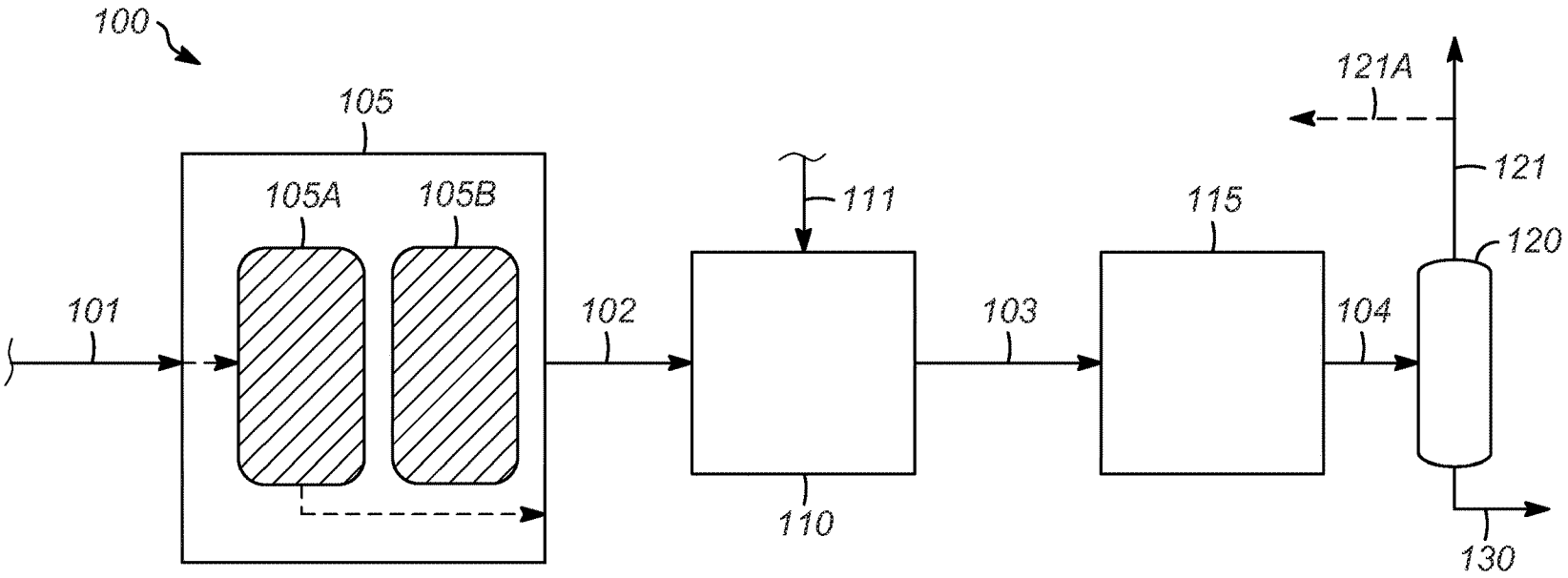
100
101
105
105A
105B
102
111
110
103
115
104
121A
121
120
130

METHODS AND SYSTEMS FOR MANUFACTURING LUBRICATION OILS

TECHNICAL FIELD

The present disclosure generally relates to methods and systems for manufacturing lubrication base oils ("lube oils"). More particularly, the present disclosure relates to methods and systems for manufacturing lube oils employing the use of activated carbon guard beds to remove polynuclear aromatic compounds.

BACKGROUND

Crude petroleum is distilled and fractionated into many products such as gasoline, kerosene, jet fuel, vacuum gas oil (VGO) and deashphalted oil (DAO), and the like. One portion of the crude petroleum forms the base of lubricating base oils used in, inter alia, the lubricating of internal combustion engines. Lube oil users are demanding ever increasing base oil quality, and refiners are finding that they need to use hydroprocessing to produce base oils that meet these higher quality specifications. New processes and higher severity are required to provide refiners with the tools for preparing high quality modern base oils, particularly using existing equipment at lower cost and with safer operation.

Finished lubricants used for such things as automobiles, diesel engines, and industrial applications generally are comprised of a lube base oil and additives. In general, a few lube base oils are used to produce a wide variety of finished lubricants by varying the mixtures of individual lube base oils of different viscosity grades and individual additives. Typically, lube base oils are simply hydrocarbons prepared from petroleum or other sources. Lube base oils are normally manufactured by making narrow cuts of vacuum gas oils from a crude vacuum tower. The cut points are set to control the final viscosity and volatility of the lube base oil.

In the prior art, Group I base oils, those with greater than 300 ppm sulfur and 10 wt. % aromatics have been generally produced by first extracting a vacuum gas oil (or waxy distillate) with a polar solvent, such as N-methyl-pyrrolidone, furfural, or phenol. The resulting waxy raffinates produced from solvent extraction process are then dewaxed, either catalytically with the use of a dewaxing catalyst such as ZSM-5, or by solvent dewaxing to improve cold flow property like pour point. The resultant base oil may be hydrofinished to improve color and other lubricant properties.

Group II base oils, those with less than 300 ppm sulfur and saturates greater than 90%, and with a viscosity index range of 80-120, have been typically produced by hydrocracking followed by selective catalytic dewaxing and hydrofinishing. Hydrocracking upgrades the viscosity index of the entrained oil in the feedstock by ring opening and aromatics saturation. The degree of aromatics saturation is thermodynamic equilibrium limited reaction, thus extent of reaction is limited by hydrogen partial pressure and reaction temperature in hydrocracking stage. In the down stream process, the hydrocracked oil is dewaxed, either by solvent dewaxing or by catalytic dewaxing, with catalytic dewaxing typically being the preferred using hydroisomerization dewaxing technology. The dewaxed oil is then preferably hydrofinished at mild temperatures to remove trace olefins and polynuclear aromatics which were may be formed due to acidic nature of in the hydrocracking/dewaxing stage and which have a strongly detrimental impact on lube base oil quality.

Group III base oils have the same sulfur and aromatics specifications as Group II base stocks but require viscosity indices above 120. These materials have been manufactured with the same type of catalytic technology employed to produce Group II base oils but with either the hydrocracker being operated at much higher severity, or with the use of very waxy feedstocks.

A typical lube hydroprocessing plant known in the prior art consists of two primary processing stages. In the lead stage, a feedstock, typically a vacuum gas oil, deasphalted oil, processed gas oils, or any combination of these materials, is hydrocracked or solvent extracted. The hydrocracking stage upgrades the viscosity index of the entrained oil in the feedstock by ring opening and aromatics saturation. The degree of aromatics saturation is limited by the high temperature and hydrogen partial pressure of the hydrocracking stage. In a second stage, the hydrocracked oil is dewaxed, preferably with the use of a highly shape-selective catalyst capable of wax conversion by isomerization. The dewaxed oil can be subsequently hydrofinished at mild temperatures to remove polynuclear aromatics (PNAs) that were not converted in the upstream hydrocracking and dewaxing stages and which have a strongly detrimental impact on lube base oil quality. Operation of the final hydrofinishing step is optimized to convert polynuclear aromatics; conversion of these species and significant conversion of one ring and two ring aromatics cannot be accomplished in the final hydrofinishing step because of its low operating temperature.

In the prior art, PNAs have been removed primarily by a noble metal catalytic process that converts the PNAs to non-aromatic compounds via saturation and cracking, for example. However, PNAs are known to cause deactivation of these catalysts, thus requiring frequent replacement and/or regeneration of the catalyst. Regeneration of the catalyst reduces process yield, increases process costs, and increases the manufacturing time for the lube oils to be manufactured.

Accordingly, it is desirable to provide improved systems and methods for the manufacture of high quality lube oils. Additionally, it is desirable to provide such methods and systems that eliminate or substantially reduces the presence of PNAs so that down stream processes do not deactivate prematurely. Furthermore, other desirable features and characteristics of the present disclosure will become apparent from the subsequent detailed description and the appended claims, taken in conjunction with the drawings and this background.

BRIEF SUMMARY

The present disclosure generally provides methods and systems for manufacturing lubricating base oils. In one exemplary embodiment, disclosed is a method for manufacturing a lubrication oil that includes the steps of receiving into an activated carbon guard bed unit an unconverted oil (UCO) from hydroprocessing unit or conventional solvent extracted raffinate feedstock. Such lube oil feedstock comprising polynuclear aromatic (PNA) compounds and contacting the feedstock with activated carbon within the activated carbon guard bed unit to remove at least a portion of the PNA compounds, thereby forming a treated base oil feedstock for dewaxing and hydrofinshing.

In another exemplary embodiment, disclosed is a system for manufacturing a lubrication oil includes an activated carbon guard bed unit that receives an unconverted oil (UCO) feedstock, the UCO feedstock comprising polynuclear aromatic (PNA) compounds, and that contacts the UCO feedstock with activated carbon within the activated carbon guard bed unit to remove at least a portion of the PNA compounds, thereby forming a treated UCO feedstock and at least one of a dewaxing unit that dewaxes the treated UCO feedstock and a hydrofinishing unit that hydrofinishes the treated UCO feedstock.

In yet another exemplary embodiment, a method for manufacturing a lubrication oil includes the steps of providing a UCO feedstock having a normal boiling point of at least 600° F. (316° C.) and selected from the group consisting of: gas oils and vacuum gas oils (VGO), hydrocracked gas oils and vacuum gas oils, deasphalted oils, slack waxes, foots oils, coker tower bottoms, reduced crude, vacuum tower bottoms, deasphalted vacuum residues, FCC tower bottoms and cycle oils and raffinates from a solvent extraction process, the UCO feedstock comprising polynuclear aromatic (PNA) compounds, receiving into an activated carbon guard bed unit the unconverted oil (UCO) feedstock, and contacting the UCO feedstock with activated carbon within the activated carbon guard bed unit to remove at least a portion of the PNA compounds, thereby forming a treated UCO feedstock. Removing at least a portion of the PNA compounds comprises removing at least a portion of the PNA compounds having five or more aromatic rings. Contacting the UCO feedstock with activated carbon comprises contacting the UCO feedstock with activated carbon in a lead guard bed of a lead/lag guard bed unit. The UCO feedstock is not contacted with a lag guard bed of the lead/lag guard be unit. The method further includes dewaxing the treated UCO feedstock by contacting the treated UCO feedstock with a dewaxing catalyst and hydrofinishing the treated UCO feedstock by contacting the treated UCO feedstock with an amorphous or crystalline metal oxide hydrofinishing catalyst.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWING

The present embodiments will hereinafter be described in conjunction with the following drawing FIGURE, wherein like numerals denote like elements, and wherein:

FIG. 1 is a process flow diagram illustrating a method implemented on a lubrication oil manufacturing system in accordance with various embodiments of the present disclosure.

DETAILED DESCRIPTION

The following detailed description is merely exemplary in nature and is not intended to limit the application and uses of the embodiments described. Furthermore, there is no intention to be bound by any theory presented in the preceding background or the following detailed description.

The present disclosure generally provides methods and systems for manufacturing lubrication oils. The embodiments described herein employ the use of activate carbon beds to remove or reduce the presence of polynuclear aromatic compounds (PNAs). As used herein, activated carbon is suitable for absorb polar multi-ring species such as PNAs. The effluent unconverted oil (UCO) from the carbon bed is low in PNAs and would allow the product to meet desired specifications upon processing in downstream lubrication oil manufacturing units, without premature deactivation of down stream catalytic processes.

Feedstocks suitable for use herein may be one or a combination of refinery streams having a normal boiling point of at least 600° F. (316° C.), although the process is also useful with oils that have initial boiling points as low as 435° F. (224° C.), and are generally referred to herein as unconverted oils (UCO). By having a normal boiling point of at least 600° F. (316° C.) is meant that 10% by volume of the feedstock has a boiling point at atmospheric pressure of at least 600° F. (316° C.). While higher boiling lube oil feedstocks can be processed in accordance with the present disclosure, the preferred feedstock will have a boiling range such that at least 85% by volume of the feedstock boils at 1250° F. (677° C.), and more preferably at most 1100° F. (593° C.). Such feedstocks, particularly vacuum gas oils, will contain from 35 wt. % to 70 wt. % aromatics, at least 40% of them being 2-ring and higher aromatics. Representative feedstocks that can be treated using the present process include gas oils and vacuum gas oils (VGO), hydrocracked gas oils and vacuum gas oils, deasphalted oils, slack waxes, foots oils, coker tower bottoms, reduced crude, vacuum tower bottoms, deasphalted vacuum residues, FCC tower bottoms and cycle oils and raffinates from a solvent extraction process. The nitrogen, sulfur and saturate contents of these feeds will vary depending on a number of factors. The preferred feedstocks for the present disclosure will have an entrained oil viscosity index of greater than 30. In a more preferred embodiment, the entrained oil in the feedstock will have a viscosity index in the range of 80-160.

FIG. 1 is a process flow diagram illustrating a method implemented on a lubrication oil manufacturing system 100 in accordance with various embodiments of the present disclosure. As shown therein, a lube oil feedstock is conducted via line 101 to an activated carbon guard bed unit 105. Activated carbon is well known in the art and may be derived from various sources including petroleum coke, coal, wood, and shells, such as coconut shells, using carbonization and/or activation process steps. Activation may be accomplished, e.g. by thermal treatment under an atmosphere of $CO_2$, $H_2O$, and mixtures thereof, by chemical treating steps, and combinations thereof. Suitable activated carbon is commercially available and may be obtained for example from Calgon Activated Corp. of Compton, Calif., USA.

The lube oil feedstock stream to be treated is contacted with activated carbon at contacting conditions to remove one or more polynuclear aromatic compounds and produce a treated lube oil feedstock stream. For example, the PNA compounds that are removed using the activated carbon are those containing, for example, five, six, or more aromatic rings. The polynuclear aromatic compounds may be removed from the lube oil feedstock stream by various mechanisms such as adsorption, reaction, and reactive adsorption with the adsorbent. The treated lube oil feedstock stream has a lower polynuclear aromatic compound content relative to the polynuclear aromatic compound content of the untreated lube oil feedstock stream. The contacting conditions include a temperature of at least about 50° C., for example from about 100° C. to about 300° C.

The activated carbon guard bed unit 105 may be configured in a lead/lag configuration including a first guard bed 105A and a second guard bed 105B. As illustrated, the guard bed unit 105 is configured for "closed loop product regeneration." The first and second guard beds 105A and 105B are configured as a swing bed arrangement in which one of the first and second guard beds 105A and 105B is in a contacting mode and the other of the first and second guard beds 105A and 105B is in a regenerative or offline mode. In particular, when a first plurality of valves are in an opened position and a second plurality of valves are in a closed position, the first guard bed 105A is in the contacting mode and the second guard bed 105B is in the regenerative or offline mode. Alternatively, when the first plurality of valves are in the closed position and the second plurality of valves are in the opened position, the first guard bed 105A is in the regenerative or offline mode and the second guard bed 105B is in the contacting mode.

As illustrated, the first guard bed 105A in the contacting mode receives the untreated lube oil feedstock stream 101 and is operating at contacting conditions, as noted above. In the regenerative mode, the second guard bed 105B, which was previously in the contacting mode, contains spent activated carbon, and does not receive the untreated lube oil feedstock stream 101. During this time, the second guard bed may be regenerated by using a suitable regeneration process, or the spent activated carbon may be substituted for fresh activated carbon. The treated lube oil feedstock continues downstream via line 102.

With the PNA compounds removed or reduced in concentration from the feedstock stream 101, the treated lube oil feedstock may be passed to catalytic dewaxing unit 110. Make-up hydrogen-containing treat gas can be introduced via line 111 when needed. Catalytic dewaxing can be performed by exposing the feedstock to a dewaxing catalyst under effective (catalytic) dewaxing conditions. Effective dewaxing conditions can include a temperature of at least 500° F. (260° C.), or at least 550° F. (288° C.), or at least 600° F. (316° C.), or at least 650° F. (343° C.). Alternatively, the temperature can be 750° F. (399° C.) or less, or 700° F. (371° C.) or less, or 650° F. (343° C.) or less. The pressure can be at least 200 psig (1.4 MPa), or at least 400 psig (2.8 MPa), or at least 750 psig (5.2 MPa), or at least 1000 psig (6.9 MPa). Alternatively, the pressure can be 2500 psig (17.2 MPa) or less, or 1200 psig (8.2 MPa) or less, or 1000 psig (6.9 MPa) or less, or 800 psig (5.5 MPa) or less. The liquid hourly space velocity (LHSV) over the dewaxing catalyst can be at least 0.1 $hr^{-1}$, or at least 0.2 $hr^{-1}$, or at least 0.5 $hr^{-1}$, or at least 1.0 $hr^{-1}$, or at least 1.5 $hr^{-1}$. Alternatively, the LHSV can be 10.0 $hr^{-1}$ or less, or 5.0 $hr^{-1}$ or less, or 3.0 $hr^{-1}$ or less, or 2.0 $hr^{-1}$ or less.

Catalytic dewaxing involves the removal and/or isomerization of long chain, paraffinic (wax) molecules from feeds. Catalytic dewaxing can be accomplished by selective cracking or by hydroisomerizing these linear molecules. Hydrodewaxing catalysts can be selected from molecular sieves such as crystalline aluminosilicates (zeolites) or silico-aluminophosphates (SAPOs). In an embodiment, the molecular sieve can be a 1-D or 3-D molecular sieve. In another embodiment, the molecular sieve can be a 10-member ring 1-D molecular sieve. Examples of molecular sieves which have shown dewaxing activity in the literature can include ZSM-48, ZSM-22, ZSM-23, ZSM-35, Beta, USY, ZSM-5, and combinations thereof. In an embodiment, the molecular sieve can be ZSM-22, ZSM-23, ZSM-35, ZSM-48, or a combination thereof. In still another embodiment, the molecular sieve can be ZSM-48, ZSM-23, ZSM-5, or a combination thereof. In yet another embodiment, the molecular sieve can be ZSM-48, ZSM-23, or a combination thereof. Optionally, the dewaxing catalyst can include a binder for the molecular sieve, such as alumina, titania, silica, silica-alumina, zirconia, or a combination thereof.

One feature of molecular sieves that can impact the activity of the molecular sieve is the ratio of silica to alumina in the molecular sieve. In an embodiment, the molecular sieve can have a silica to alumina ratio of 200 to 1 or less, or 120 to 1 or less, or 100 to 1 or less, or 90 to 1 or less, or 75 to 1 or less. In an embodiment, the molecular sieve can have a silica to alumina ratio of at least 30 to 1, or at least 50 to 1, or at least 65 to 1.

The dewaxing catalyst can also include a metal hydrogenation component, such as a Group VIII metal. Suitable Group VIII metals can include Pt, Pd, Ni, or a combination thereof. The dewaxing catalyst can include at least 0.1 wt % of a Group VIII metal, or at least 0.3 wt %, or at least 0.5 wt %, or at least 1.0 wt %, or at least 2.5 wt %, or at least 5.0 wt %. Alternatively, the dewaxing catalyst can include 10.0 wt % or less of a Group VIII metal, or 5.0 wt % or less, or 2.5 wt % or less, or 1.5 wt % or less, or 1.0 wt % or less. In some embodiments, the dewaxing catalyst can also include at least one Group VIB metal, such as W or Mo. Such Group VIB metals are typically used in conjunction with at least one Group VIII metal, such as Ni or Co. An example of such an embodiment is a dewaxing catalyst that includes Ni and W, Mo, or a combination of W and Mo. In such an embodiment, the dewaxing catalyst can include at least 0.5 wt % of a Group VIB metal, or at least 1.0 wt %, or at least 2.5 wt %, or at least 5.0 wt %. Alternatively, the dewaxing catalyst can include 20.0 wt % or less of a Group VIB metal, or 15.0 wt % or less, or 10.0 wt % or less, or 5.0 wt % or less, or 1.0 wt % or less. In an embodiment, the dewaxing catalyst can include Pt, Pd, or a combination thereof. In another embodiment, the dewaxing catalyst can include Co and Mo, Ni and W, Ni and Mo, or Ni, W, and Mo.

With continued reference to FIG. 1, the effluent from catalytic dewaxing unit is sent to hydrofinishing unit 115 via line 103. The hydrofinishing step following dewaxing offers further opportunity to improve product quality without significantly affecting its pour point. Hydrofinishing is a mild, relatively cold hydrotreating process, that employs a catalyst, hydrogen and mild reaction conditions to remove trace amounts of heteroatom compounds, aromatics and olefins, to improve primarily oxidation stability and color. Hydrofinishing reaction conditions include temperatures from 300° F. to 675° F. (149° C. to 357° C.), preferably from 300° F. to 600° F. (149° C. to 315° C.), a total pressure of from 400 to 3000 psig (2859 to 20786 kPa), a liquid hourly space velocity ranging from 0.1 to 5 LHSV ($hr^{-1}$), preferably 0.5 to 3 $hr^{-1}$. The hydrotreating catalyst will comprise a support component and one or more catalytic metal components. The one or more metals are selected from Group VIB (Mo, W, Cr) and Group VIII (Ni, Co and the noble metals Pt and Pd). The metal or metals may be present from as little as 0.1 wt % for noble metals, to as high as 30 wt % of the catalyst composition for non-noble metals. Preferred support materials are low in acid and include, for example, amorphous or crystalline metal oxides such as alumina, silica, silica alumina and ultra large pore crystalline materials known as mesoporous crystalline materials, of which MCM-41 is a preferred support component. Unsupported base metal (non-noble metal) catalysts are also applicable as hydrofinishing catalysts.

The effluent stream from hydrofinishing unit 115 is passed via line 104 to a separation unit 120, wherein a gaseous effluent stream 121 is separated from the resulting liquid phase lube oil base stock. The gaseous effluent stream 121, a portion of which will be unreacted hydrogen-containing treat gas can be recycled via line 121A to dewaxing unit 110, for example. The resulting lube oil base stock, which will meet Group II or Group III base oil requirements, is collected via line 130, and sent downstream for collection or further processing, if desired.

Accordingly, embodiments of the present disclosure provide methods and systems for manufacturing lubrication oils. The embodiments described herein employ the use of activate carbon beds to remove or reduce the presence of polynuclear aromatic compounds (PNAs). As used herein, activated carbon is suitable for absorb polar multi-ring species such as PNAs. The effluent unconverted oil (UCO) from the carbon bed is low in PNAs and would allow the product to meet desired specifications upon processing in downstream lubrication oil manufacturing units, without premature deactivation of down stream catalytic processes.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the application in any way. Rather, the foregoing detailed description will provide those skilled in the art with a convenient road map for implementing one or more embodiments, it being understood that various changes may be made in the function and arrangement of elements described in an exemplary embodiment without departing from the scope, as set forth in the appended claims.

What is claimed is:

1. A method for manufacturing a lubrication oil, the method comprising the steps of:

hydrocracking a gas oil feedstock to provide a hydrocracked unconverted oil (UCO);

receiving into an activated carbon guard bed unit said UCO feedstock, the UCO feedstock comprising polynuclear aromatic (PNA) compounds; and contacting the UCO feedstock with activated carbon within the activated carbon guard bed unit to remove at least a portion of the PNA compounds, thereby forming a treated UCO feedstock; and catalytically dewaxing the treated UCO feedstock directly following the contacting step.

2. The method of claim 1, wherein dewaxing comprises contacting the treated UCO feedstock with a dewaxing catalyst.

3. The method of claim 1, further comprising hydrofinishing the treated UCO feedstock.

4. The method of claim 3, wherein hydrofinishing comprises contacting the treated UCO feedstock with an amorphous or crystalline metal oxide hydrofinishing catalyst.

5. The method of claim 1, wherein contacting the UCO feedstock with activated carbon comprises contacting the UCO feedstock with activated carbon in a lead guard bed of a lead/lag guard bed unit, and wherein the UCO feedstock is not contacted with a lag guard bed of the lead/lag guard be unit.

6. The method of claim 1, further comprising providing the UCO feedstock.

7. The method of claim 6, wherein providing the UCO feedstock comprises providing a UCO feedstock having a normal boiling point of at least 600° F. (316° C.).

8. The method of claim 1, wherein removing at least a portion of the PNA compounds comprises removing at least a portion of the PNA compounds having five or more aromatic rings.

9. A method for manufacturing a lubrication oil, the method comprising the steps of:

providing a UCO feedstock having a normal boiling point of at least 600° F. (316° C.) and selected from the group consisting of: gas oils and vacuum gas oils (VGO), hydrocracked gas oils and vacuum gas oils, deasphalted oils, slack waxes, foots oils, coker tower bottoms, reduced crude, vacuum tower bottoms, deasphalted vacuum residues, FCC tower bottoms and cycle oils and raffinates from a solvent extraction process, the UCO feedstock comprising polynuclear aromatic (PNA) compounds;

receiving into an activated carbon guard bed unit the unconverted oil (UCO) feedstock;

contacting the UCO feedstock with activated carbon within the activated carbon guard bed unit to remove at least a portion of the PNA compounds, thereby forming a treated UCO feedstock, wherein removing at least a portion of the PNA compounds comprises removing at least a portion of the PNA compounds having five or more aromatic rings, and wherein contacting the UCO feedstock with activated carbon comprises contacting the UCO feedstock with activated carbon in a lead guard bed of a lead/lag guard bed unit, and wherein the UCO feedstock is not contacted with a lag guard bed of the lead/lag guard be unit;

dewaxing the treated UCO feedstock directly following the contacting step by contacting the treated UCO feedstock with a dewaxing catalyst; and hydrofinishing the treated UCO feedstock by contacting the treated UCO feedstock with an amorphous or crystalline metal oxide hydrofinishing catalyst.

10. A method for manufacturing a lubrication oil, the method comprising the steps of:

receiving into an activated carbon guard bed unit an unconverted oil (UCO) feedstock, the UCO feedstock comprising polynuclear aromatic (PNA) compounds; and contacting the UCO feedstock with activated carbon within the activated carbon guard bed unit to remove at least a portion of the PNA compounds, thereby forming a treated UCO feedstock;

catalytically dewaxing the treated UCO feedstock directly following the contacting step; and hydrofinishing the treated UCO feedstock.

11. The method of claim 10, wherein dewaxing comprises contacting the treated UCO feedstock with a dewaxing catalyst.

12. The method of claim 10, wherein hydrofinishing comprises contacting the treated UCO feedstock with an amorphous or crystalline metal oxide hydrofinishing catalyst.

13. The method of claim 10, wherein contacting the UCO feedstock with activated carbon comprises contacting the UCO feedstock with activated carbon in a lead guard bed of a lead/lag guard bed unit, and wherein the UCO feedstock is not contacted with a lag guard bed of the lead/lag guard be unit.

14. The method of claim 10, further comprising providing the UCO feedstock by hydrocracking gas oil.

15. The method of claim 10, further providing the UCO feedstock comprising a normal boiling point of at least 600° F. (316° C.).

16. The method of claim 15, wherein providing the UCO feedstock comprises providing a UCO feedstock selected from the group consisting of: gas oils and vacuum gas oils (VGO), hydrocracked gas oils and vacuum gas oils, deasphalted oils, slack waxes, foots oils, coker tower bottoms, reduced crude, vacuum tower bottoms, deasphalted vacuum residues, FCC tower bottoms and cycle oils and raffinates from a solvent extraction process.

17. The method of claim 10, wherein removing at least a portion of the PNA compounds comprises removing at least a portion of the PNA compounds having five or more aromatic rings.

* * * * *